US008769715B2

(12) United States Patent
Bergmann

(10) Patent No.: US 8,769,715 B2
(45) Date of Patent: Jul. 8, 2014

(54) PROTECTIVE GEAR

(75) Inventor: Dieter Bergmann, Sollentuna (SE)

(73) Assignee: Bergmann & de Jounge AB, Djursholm (SE)

( * ) Notice: Subject to any disclaimer, the term of this patent is extended or adjusted under 35 U.S.C. 154(b) by 128 days.

(21) Appl. No.: 12/867,642

(22) PCT Filed: Feb. 8, 2009

(86) PCT No.: PCT/SE2009/050122
§ 371 (c)(1),
(2), (4) Date: Oct. 29, 2010

(87) PCT Pub. No.: WO2009/102268
PCT Pub. Date: Aug. 20, 2009

(65) Prior Publication Data

US 2011/0041227 A1 Feb. 24, 2011

(30) Foreign Application Priority Data

Feb. 14, 2008 (SE) ..... 0800334

(51) Int. Cl.
*A41D 13/00* (2006.01)

(52) U.S. Cl.
USPC ..... 2/22

(58) Field of Classification Search
USPC ..... 2/22, 19, 20, 23, 24, 456, 455, 44, 45; 602/6, 23
See application file for complete search history.

(56) References Cited

U.S. PATENT DOCUMENTS

| | | | | | |
|---|---|---|---|---|---|
| 833,546 | A | * | 10/1906 | Pierce | 2/22 |
| 1,253,260 | A | * | 1/1918 | Levinson | 2/462 |
| 1,428,731 | A | * | 9/1922 | Whitley | 2/22 |
| 1,607,032 | A | * | 11/1926 | Whitley | 2/22 |
| 1,688,676 | A | * | 10/1928 | Whitley | 2/22 |
| 1,784,148 | A | * | 12/1930 | Levinson | 2/22 |
| 1,812,579 | A | * | 6/1931 | Bischoff | 2/22 |
| 2,544,065 | A | * | 3/1951 | Carr | 2/22 |
| 2,553,612 | A | * | 5/1951 | Taylor | 2/22 |
| 2,818,571 | A | * | 1/1958 | Grant | 2/22 |

(Continued)

FOREIGN PATENT DOCUMENTS

| | | |
|---|---|---|
| DE | 93 07 949 U1 | 9/1993 |
| EP | 1 177 732 A2 | 2/2002 |

(Continued)

OTHER PUBLICATIONS

International Search Report for corresponding International Application No. PCT/SE2009/050122 mailed May 15, 2009.

(Continued)

*Primary Examiner* — Richale Quinn
(74) *Attorney, Agent, or Firm* — Renner, Otto, Boisselle, & Sklar LLP

(57) ABSTRACT

Protection for a body part of a user, such as a leg protection for a football player, comprising a stiff protective plate with a shape being adapted to the body part. This protective plate, which preferably is fiber reinforced, displays an outer surface arranged to be turned away from the user and an inner surface arranged to be turned facing the user. One or more shock absorbing elements, such as strips or cones, are arranged on the inner surface of the protective plate, along the periphery of the protective plate. Thereby a protection is achieved which has a low weight, is gentle to the skin and stays well in place.

16 Claims, 9 Drawing Sheets

(56) References Cited

U.S. PATENT DOCUMENTS

| | | | | |
|---|---|---|---|---|
| 3,585,639 | A * | 6/1971 | Enicks | 2/22 |
| 3,877,077 | A * | 4/1975 | Chapdelaine | 2/22 |
| 4,001,953 | A * | 1/1977 | Fugere et al. | 36/2 R |
| D280,145 | S * | 8/1985 | Vacanti | D29/120.1 |
| 4,688,269 | A * | 8/1987 | Maeshima | 2/456 |
| 4,766,614 | A | 8/1988 | Cantwell et al. | |
| 5,007,111 | A * | 4/1991 | Adams | 2/22 |
| 5,093,931 | A * | 3/1992 | LaBerge et al. | 2/22 |
| 5,405,312 | A * | 4/1995 | Jacobs | 602/5 |
| 5,544,663 | A * | 8/1996 | Duback | 128/846 |
| 5,617,580 | A * | 4/1997 | DiCesare et al. | 2/22 |
| 6,065,152 | A * | 5/2000 | Parker | 2/22 |
| 6,178,556 | B1 * | 1/2001 | Foreman et al. | 2/22 |
| 6,432,513 | B1 * | 8/2002 | Thomsen et al. | 428/167 |
| 6,681,403 | B2 * | 1/2004 | Lyden | 2/22 |
| 6,789,264 | B2 * | 9/2004 | Budda | 2/22 |
| 7,517,331 | B2 * | 4/2009 | Reinhardt et al. | 602/61 |
| 7,937,768 | B2 * | 5/2011 | Behrend et al. | 2/22 |
| RE42,689 | E * | 9/2011 | Taylor | 156/265 |
| 8,060,944 | B2 * | 11/2011 | Lueking | 2/22 |
| 2003/0088900 | A1 * | 5/2003 | Cho | 2/22 |
| 2004/0094915 | A1 * | 5/2004 | Warren | 280/11.19 |
| 2005/0251901 | A1 * | 11/2005 | Link | 2/462 |
| 2005/0268387 | A1 | 12/2005 | Wong | |

FOREIGN PATENT DOCUMENTS

| | | | |
|---|---|---|---|
| FR | 2 600 900 | A1 | 1/1988 |
| FR | 2 809 597 | A3 | 12/2001 |
| GB | 671 022 | A | 4/1952 |
| WO | 2006/092551 | | 9/2006 |
| WO | 2006/092551 | A1 | 9/2006 |

OTHER PUBLICATIONS

Supplementary Search Report for corresponding European Application No. 09711322.9 mailed Jan. 3, 2013.

* cited by examiner

PROTECTIVE GEAR

This application is a national phase of International Application No. PCT/SE2009/050122 filed Feb. 6, 2009 and claims priority to SE 0800334-5 filed Feb. 14, 2008 and published in the English language.

FIELD OF THE INVENTION

The present invention relates to protection generally for persons and particularly leg protection for sporting persons, such as football players.

BACKGROUND

In many sports, such as football, the contestants should, to prevent injuries, wear protection for the body parts that otherwise is easily injured. In for example football leg protection is an example of such a protection. Other sports where leg protection is being used is handball, field hockey, downhill skiing and protection is also used in trotting. Such protection should have multiple properties. They must be able to absorb strokes an shocks without the underlying body part getting injured. Furthermore they must remain in place in a reliable way, even during the practicing of physical activities.

Example of known protection, of which FIG. 1 shows a cross sectional view through a leg protection for footballers, displaying a deformable protective plate 2, which is shaped after the underlying body part, in this case the leg 4 of a user. This protective plate shall protect against for example strokes and shocks from for example studs of football shoes. Since the protective plate is deformable it is deformed when hit by a kick or another stroke. For preventing that shocks and strokes continues to the underlying body part a sawn on contact layer 6 of a soft material, such as plastic foam, is present on the surface of the protective plate which is facing the body. This contact layer is in use in direct contact with the user's skin. For keeping the protection in place, fastening arrangements 8, such as straps etc., are attached to the protective plate or the contacting layer.

Such known protection has multiple disadvantages. Of these can be mentioned that they are experienced as bulky and heavy, the extend from the leg further which can lead to bad ball handling, due to their higher weight they consume more energy of the user during training or match. Furthermore, they are poorly ventilated, which can lead to irritated skin and skin problems in the long run, such as eczema and bacterial wounds. Ventilation holes in the protection inevitably leads to weakening of the deformable protective plate. Furthermore, the soft material makes the protective plate move around and has a hard time staying properly in place. Due to that the protective plate is deformable it distributes the force of the incoming shock relatively bad and the protection may also rub against the leg.

SUMMARY OF THE INVENTION

A purpose of the present invention is hence to achieve a protection of the prior mentioned kind, by which the above stated problems with the prior art is avoided or at least minimized.

The invention is based on the understanding that the contacting surface towards the underlying skin can be minimized through a protection for a body part of a person being designed with a stiff protective plate, which as such do not absorb any shocks, and one or more shock absorbing elements arranged along the periphery of the protective plate on the side facing the body part.

According to a first aspect of the invention a protection is achieved for a body part of a user, which is characterized by a stiff protective plate with a shape which is adapted to the body part, which protective plate displays an outer surface arranged to be turned away from the user and an inner surface arranged to be turned facing the user, and at least one shock absorbing element arranged on the inner surface of the protective plate along the periphery of the of the protective plate. This refers to a shock absorbing element arranged in proximity of, or directly by the periphery of the protective plate.

With the protection according to the invention many advantages is achieved. A very well ventilated protection is obtained which further can be manufactured with very low weight. The protective property is good and conventional fastening can be left out due to considerably lower weight and in relation more friction on contacting shock absorbing elements, which simplifies the use.

In one preferred embodiment the shock absorbing elements comprises strips, which preferably runs along the periphery of the inner surface of the protective plate. Alternatively or as ca complement, the shock absorbing elements comprises cones or peaks, which are placed with mutual distance.

Through designing the protective plate from one or more layers of plastic reinforced with fibers, such as carbon fiber reinforced plastic or aramide fiber reinforced plastic, a light but still stiff construction in achieved.

The protection can be provided with ventilation holes in the shock absorbing elements or in the protective plate for draining condensation. Further embodiments are defined by the dependant claims.

BRIEF DESCRIPTION OF THE DRAWINGS

The invention will now be described in embodiments, with reference to the enclosed drawings, in which.

DETAILED DESCRIPTION OF PREFERRED EMBODIMENTS

In the following a detailed description of preferred embodiments will be given. It shall be noted that direction presented in the description, such as "horizontal" and "vertical" only refers to what is shown in the figures and shall not in any way be considered limiting apart from that.

Figure 2:
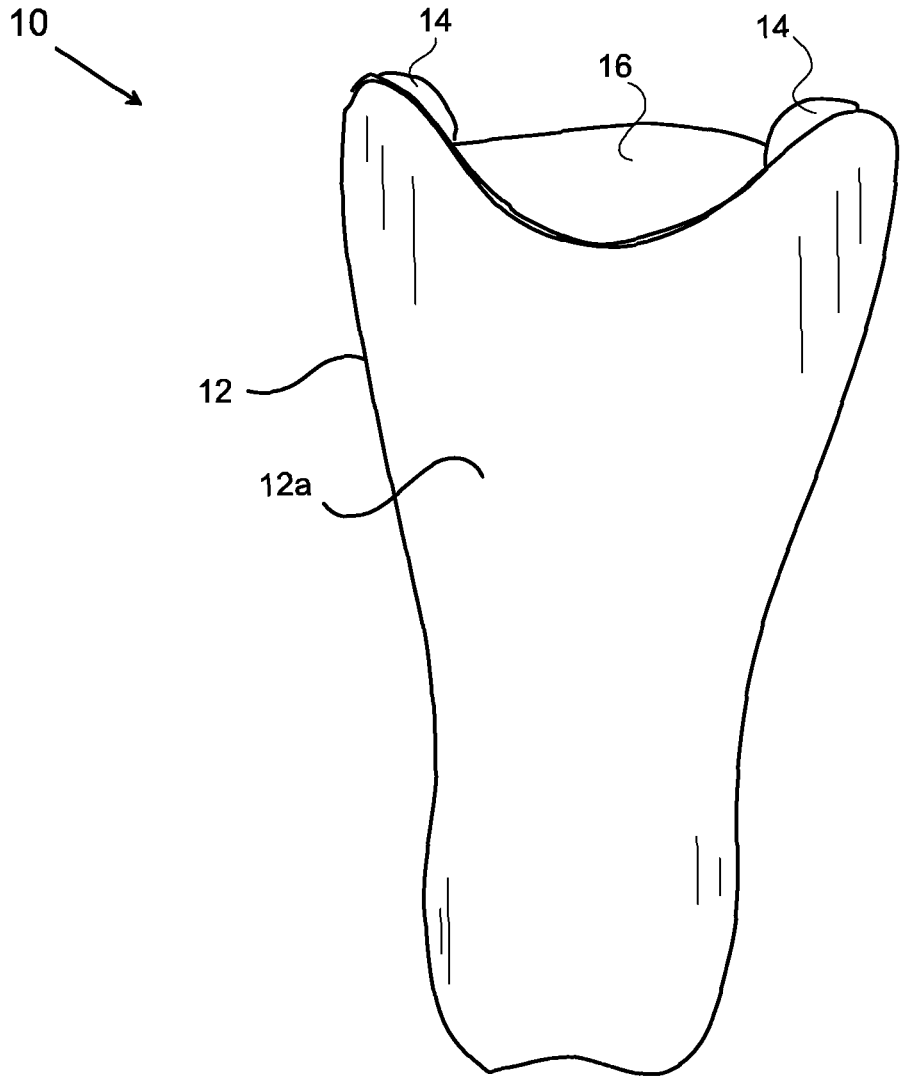
FIG. 2 is a perspective view of the front of a protection in accordance with the invention.
Figure 3:
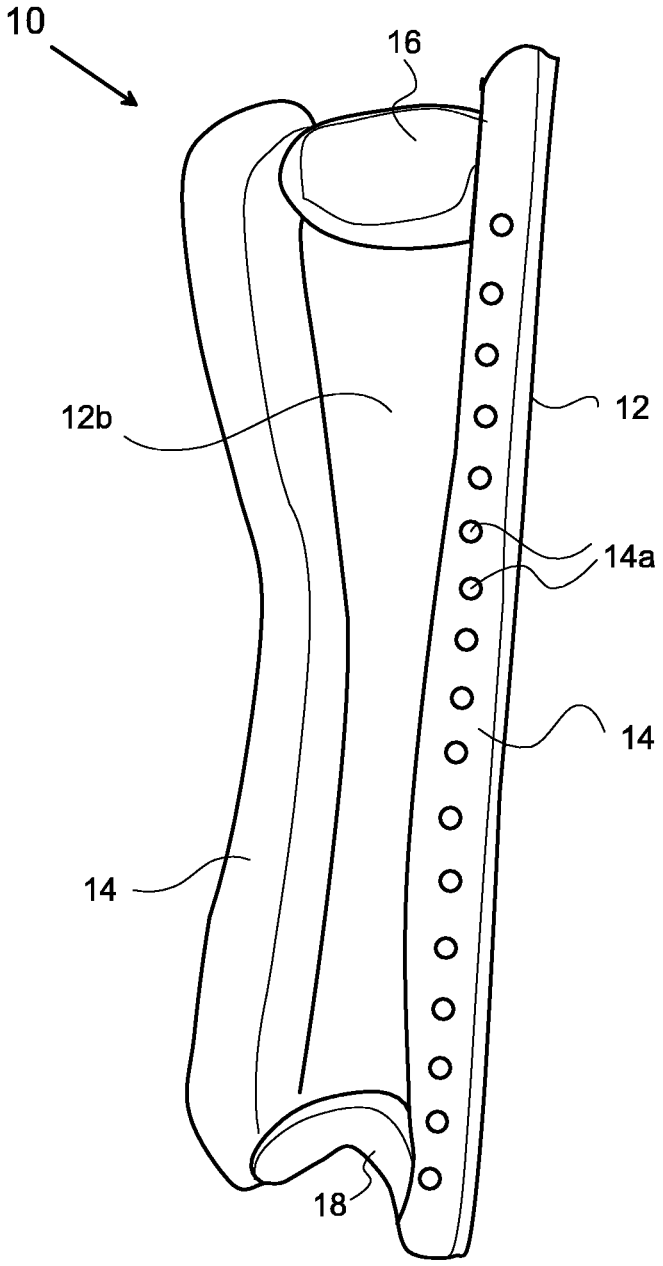
FIG. 3 is a perspective view of the rear of the protection in FIG. 2.

The protection according to the invention shown in FIGS. 2 and 3, which is a protection 10 for footballers, displaying a stiff protective plate 12 with a shape which is adapted to the body part, in this case the user's shinbone. The protective plate 12 displays an outer surface 12*a*, which, when the protection is in use is turned away from the user and an inner surface 12*b* which is facing the user. Furthermore, see FIG. 3, the leg protection 10 displays shock absorbing elements in the shape of strips 14, which runs along the periphery of the inner surface of the protective plate 12*b* along the side edges 12 of the protective plate. Preferably the strips 14 are fixated to the protective plate with glue only on the far edges of the protective plate. A cushion, which can be of the same material as the strips 14 is arranged by the upper edge of the protective plate and a corresponding cushion 18 by the lower edge of the protective plate 12.

Figure 1:
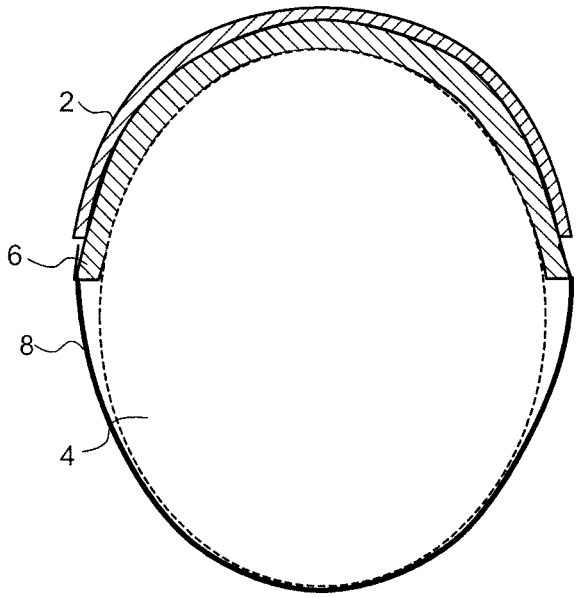
Fig. 1 (Prior art)
FIG. 1 is a cross section through a protection in accordance with the prior art.
Figure 4:
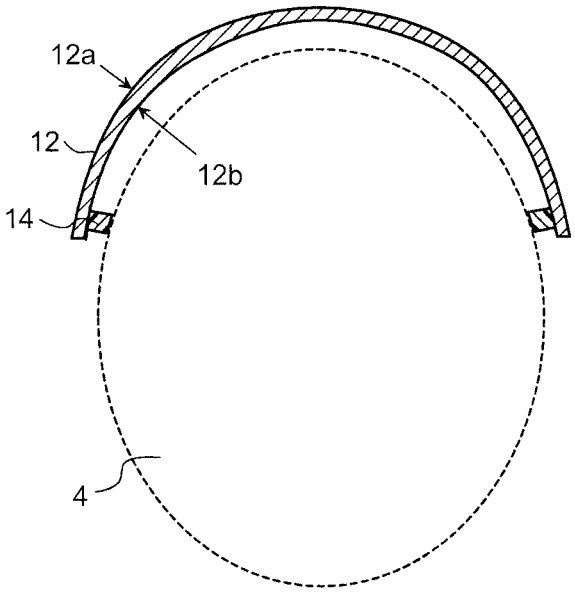
FIG. 4 is a cross section through the protection displayed in FIGS. 2 and 3.

The placing of the strips 14 appears evidently in the cross section view of FIG. 4. It is here seen that a space is created between the protective plate 12 and the bone 4, whereby a large contacting surface is avoided, which can lead to the above mentioned problems with skin irritations etc. The ventilation of this space can be improved in multiple ways. One way is to arrange each cushion 16, 18 such that there is an opening between the protective plate 12 and each cushion 16, 18, wherein air can pass in and out of these openings. Another way is to design the strips 14 with a through-going hole 14*a*, see FIG. 3, which runs across the length of the strip. An alternative to this is that the shock absorbing strips are designed with mutual spaces along the periphery such that through let of air is enabled in these spaces.

Figure 5:
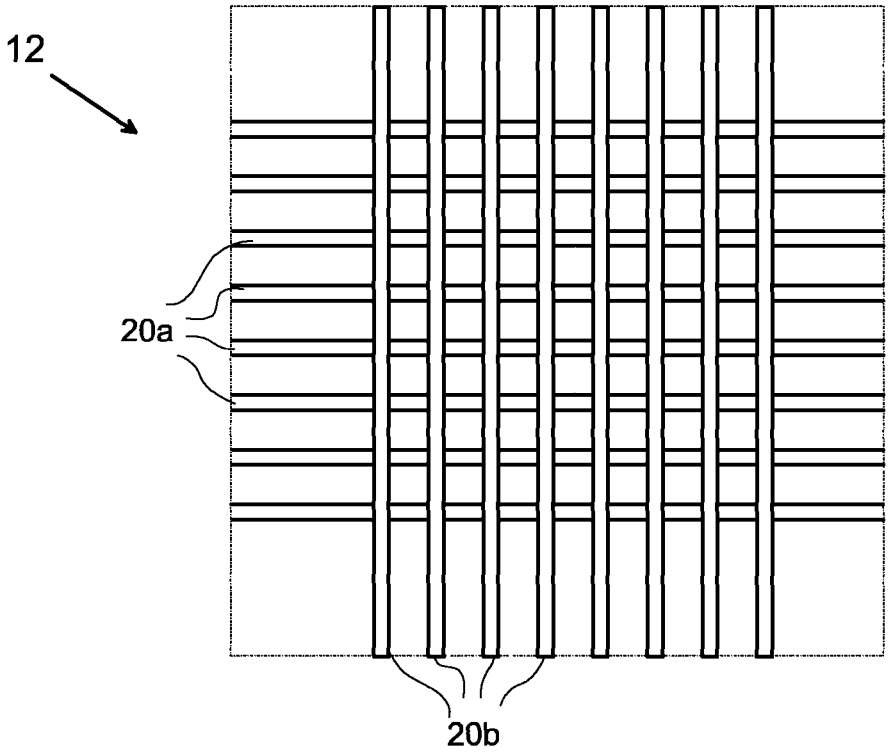
FIG. 5 shows a detailed view of the reinforcement of a protective plate which is part of a protection according to the present invention.

The protective plate is according to a preferred embodiment made from one or multiple layers of plastic reinforced by fibers, where the different layers can have different direction of the fibers. One example of this is shown in FIG. 5, where the directions of the fibers in different layers are mutually perpendicular. Hence the fiber reinforcement compresses a first layer 20*a*, which runs mutually parallel in a first direction, and a second fiber layer 20*b*, which runs mutually parallel in a second direction substantially perpendicular to the first direction. The direction 0°/90°, i.e. mutual fiber directions where when 0° the fiber runs strictly vertical and by 90° the fiber runs strictly horizontal. This makes the protective plate stiff horizontally and vertically, but rotatable in directions there between for improving the fitting against the leg. Fiber directions, foremost in directions ±45° in relation to horizontal and vertical, are for obtaining the correct stiffness in the rotational axis. For example it is preferable to use carbon fiber and/or aramide fiber for obtaining a stiff but yet light protective plate 12.

Through this reinforcement a protective plate is obtained which substantially does not deform at a shock against the protective plate. The force from the shock is distributed over the protective plate and is instead concentrated to the shock or energy absorbing elements in shape of the strips 14, which absorbs the main part of the force, instead of propagating the force into the underlying body part, in this case the bone/heel. The energy absorbing strips 14 are preferably made of an elastic material, such as energy absorbing rubber or an "air cushion strip", and is shaped such that they in their unloaded state gives as small contact surface as possible against the underlying body part. When a force is exerted on the protective plate the strips will deform, whereby the contacting surface increases. Thereby the friction between the strips 14 and the underlying skin is increased, which contributes to keeping the protection in place, whereby you do not need any extra fastening arrangements, such as straps. The remaining force from the impact which has not been absorbed by the strip 14 will thereafter reach the skin, whereafter it propagates into the bone.

Figure 6:
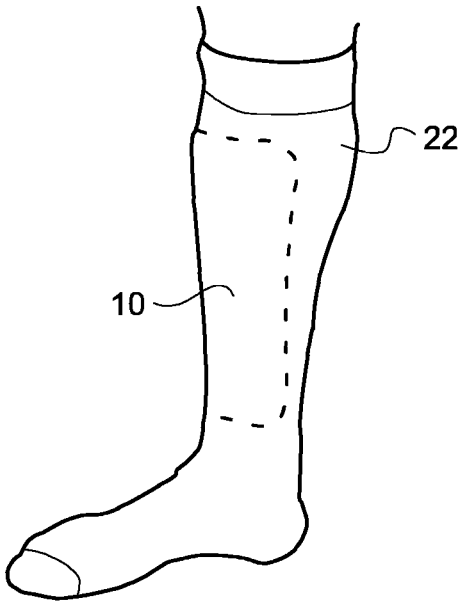
FIG. 6 shows a textile for keeping the protection in place.

The protection 10 is preferably held in place by means of an elastic textile 22, which also functions as a user's sock, se FIG. 6.

Figure 7:
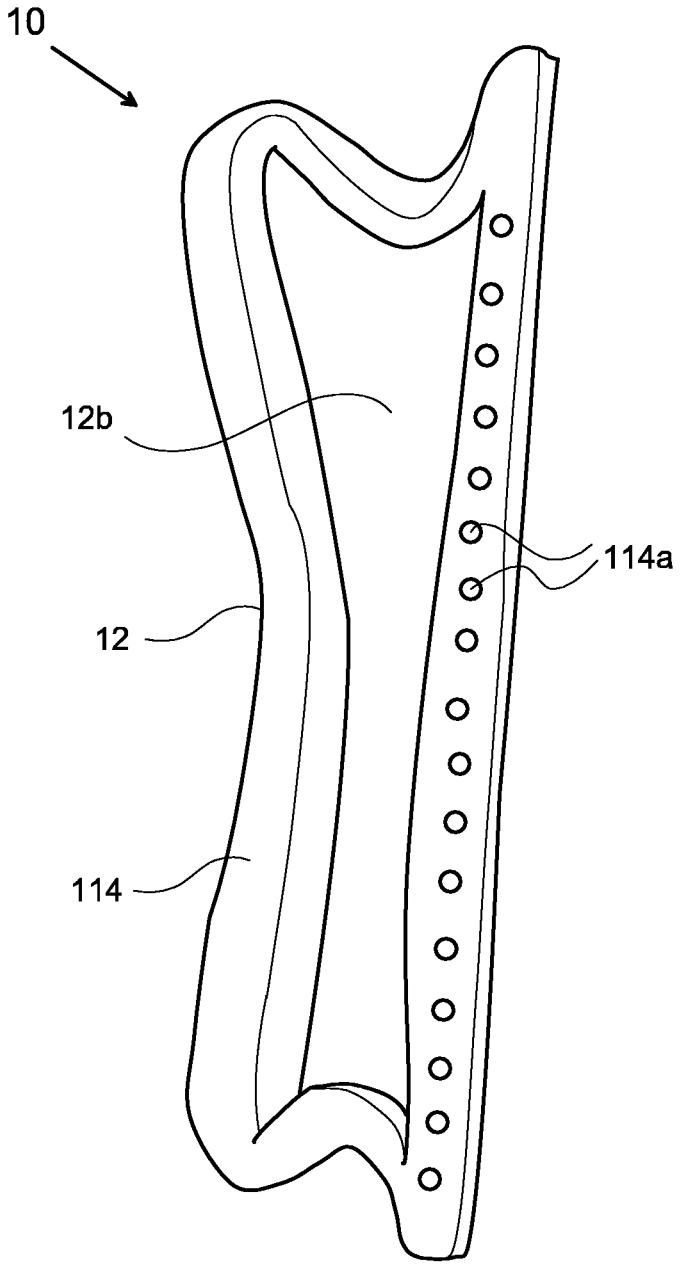
FIG. 7 shows an alternative embodiment of a protection according to the invention.

In an alternative embodiment, which is shown in FIG. 7, the two strips 14 and the cushions 16, 18 has been replaced by a single strip 114 which runs along the entire periphery of the protective plate 12. Just as in the embodiment described above with reference to FIG. 3 the single strip is designed with through-going ventilation holes 114*a*.

Figure 8:
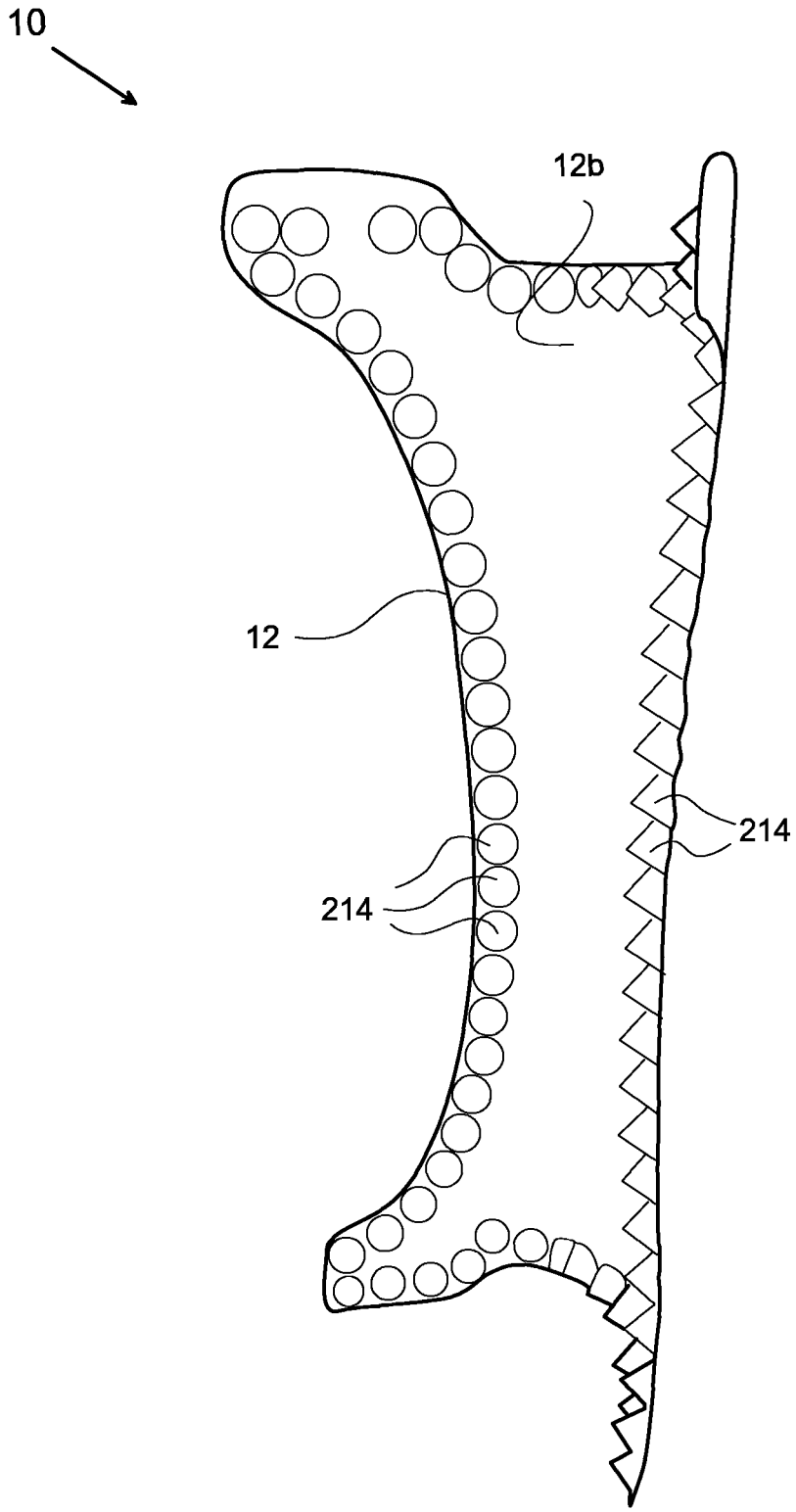
FIG. 8 shows yet another alternative embodiment of a protection according to the invention.

An alternative to designing the shock absorbing elements as one or more strips is to arrange the elements as preferably circular peaks or cones 214, which are placed with mutual spaces on the inner surface of the protective plate along the periphery of the protective plate, see FIG. 8. With other words is the shock absorbing elements designed as peaks and valleys, wherein only the peaks are contacting the user's body in the normal state. At a shock will however all of the shock absorbing elements 214 absorb and distribute the force from the shock through that then even the valleys will come in contact with the body of the user. If the spaces between the peaks or cones 214 are the only ventilation, there will be a shock absorbing air cushion as soon as the valleys also come into contact with the body of the user, wherein they seal against the body.

Figure 9:
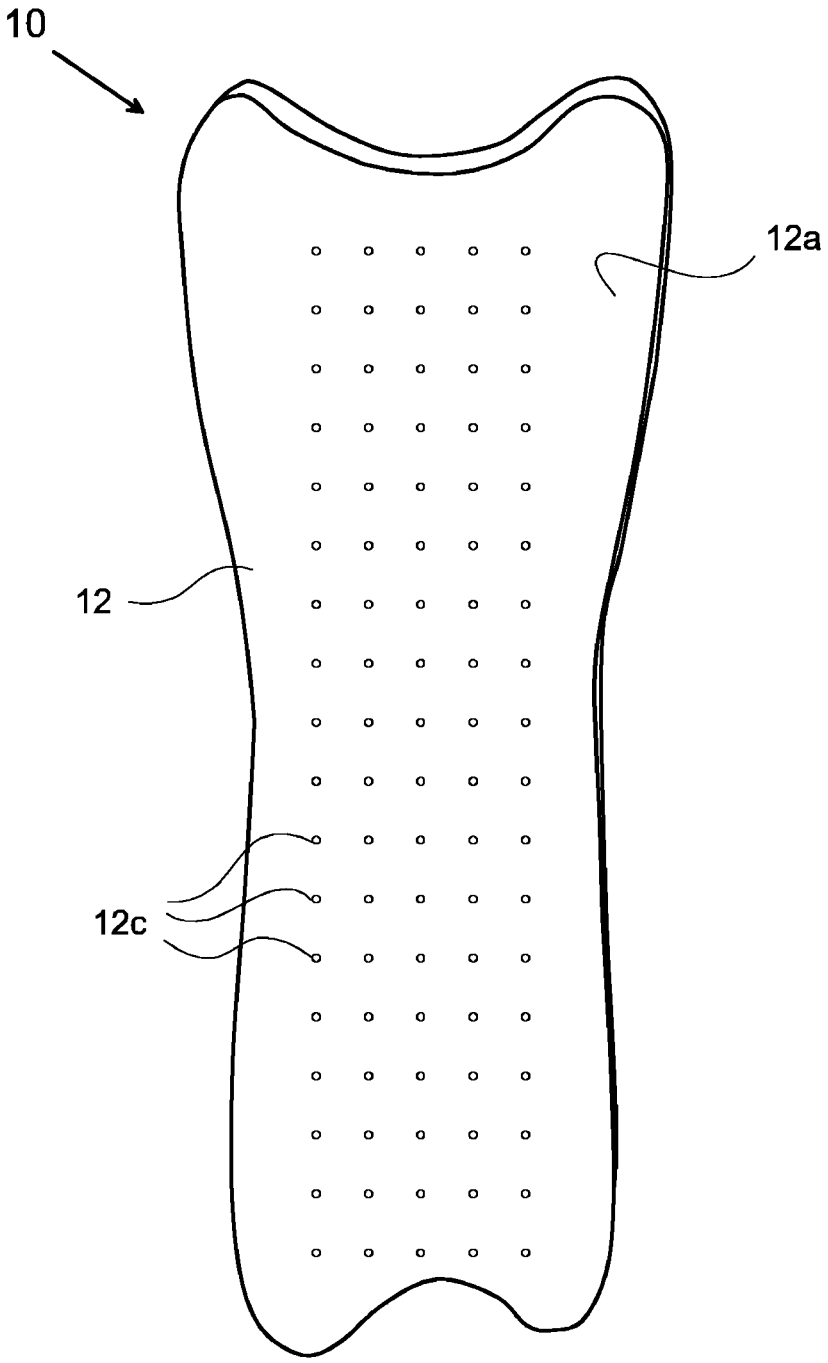
FIG. 9 shows the front of a protection according to the invention, of which the placing of the ventilation holes is shown.

An alternative or complement to designing the shock absorbing element with ventilation holes is that the protective plate 12 shows through-going holes for draining of condensate from the space between the protective plate and the user's body. In FIG. 9, which shows the front 12*a* of the protective plate 12 on a leg protection 10, it is seen that the protective plate shows a multiplicity of small through-going holes 12*c*, which in this embodiment are arranged in rows and columns. This multiplicity of small holes, which preferably can have a diameter of 0.5-1.5 millimeter, let the formed condensate out.

Figure 10:
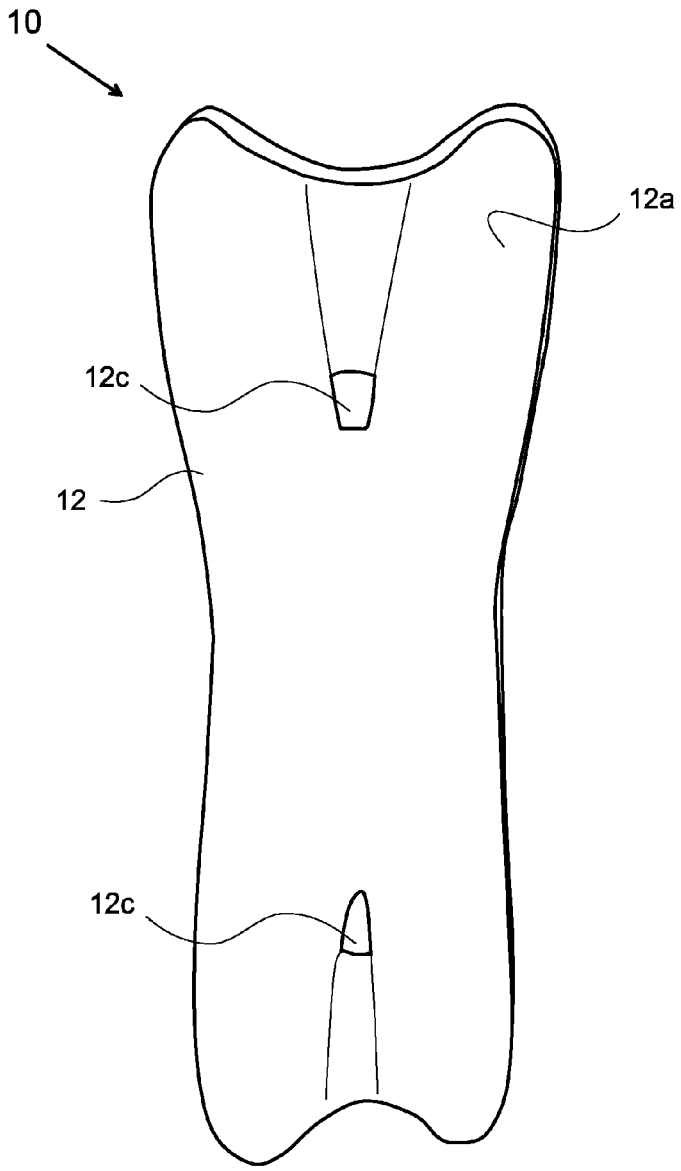
FIG. 10 shows an alternative embodiment of ventilation holes.
Figure 11:
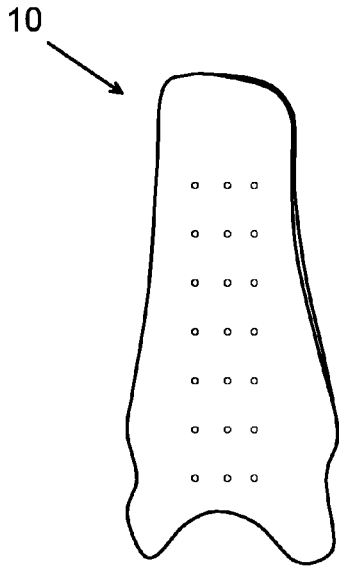
FIG. 11 shows an alternative embodiment being a heel protection.

An alternative design of ventilation holes is shown in FIG. 10, where the protective plate 12 displays less, in the shown example two, but larger through-going ventilation holes 12*c*. In this case the through-going holes can preferably have a diameter of 5-15 millimeter. A leg protection that protects the user's shinbone has been described. In an alternative embodiment, which is shown in FIG. 11, the protective plate has a size and shape adapted to be placed on the rear side of the user's leg such that the protective plate 12 covers the user's Achilles tendon. Whereby a protection is achieved, which protects for example football players against the commonly occurring injuries that arises with kicks from the rear.

Figure 12:
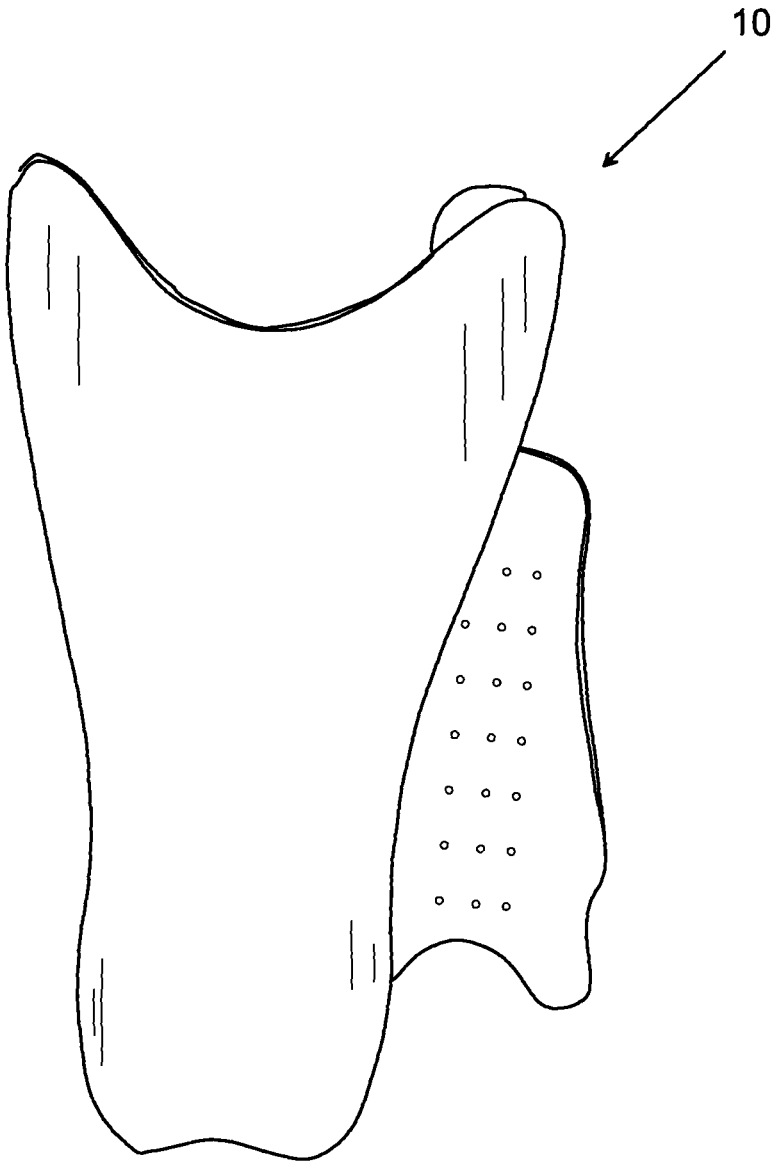
FIG. 12 shows a combination of front and back protection.

The embodiment shown in FIG. 11 can preferably be combined with any of the above described leg protections which protects the shin bone, see FIG. 12. Hence the protection comprises a protective plate which has a size and shape that is adapted for placing on the rear side of the user's leg such that the protective plate 12 covers the user's Achilles tendon, and a protective plate that has a size and shape adapted for placing on the front of the user's leg such that the protective plate covers the user's shinbone. In this case, the two protective plates can be kept together by e.g. means of straps. As shown, the protective plate 12 may extend along a central axis from a top side to a bottom side, and may flare transversely outward from the axis towards the bottom side. The protective plate 12 may also include bottom wings extending from the bottom side in an axially downward and transversely outward direction.

Preferred embodiments of a protection according to the invention have been described. It is understood that the invention can be altered within the scope of appended claims. Hence a protection for football players has been described. It is understood that the principle according to the invention with a stiff protective plate and a shock absorbing strip arranged along the periphery of the protective plate can be applied on other body parts such as upper and lower arms and other sports such as handball, field hockey, downhill skiing, motorcycle sports, trotting (horse leg protection), rugby, American football and cricket.

The described different ways of ventilating the space between the protective plate 12 and the body of the user 4 can be used separately or in optional combinations. It is also conceivable to exclude the ventilation. It is also understood, that the different embodiments of shock absorbing elements can be mixed in one embodiment. For example one could alternate between distances of strips, such as shown in FIG. 3, and distances of peaks, as shown in FIG. 8.

The invention claimed is:

1. Protection for a body part of a user, comprising a stiff protective plate with a shape adapted to the body part, which protective plate displays an outer surface arranged to be turned away from the user in a facially outward direction, an inner surface arranged to be facing the user in a facially inward direction generally opposite the facially outward direction, and a peripheral edge defining an edgeward direction generally parallel to the inner and outer surfaces, and at least one shock absorbing element arranged on the inner surface only along the periphery of the inner surface, the protective plate and the at least one shock absorbing element define an inner chamber of the protection, wherein said at least one shock absorbing element comprises at least one strip displaying peripherally spaced peaks or cones with edgewardly extending mutual spaces therebetween, the mutual spaces configured to provide fluid communication between the inner chamber and a location edgewardly outward of the protection, and wherein the protective plate displays one or more through-going ventilation holes configured to provide fluid communication between the inner chamber and a location facially outward of the protection.

2. Protection according to claim 1, wherein said at least one shock absorbing element is made from an elastic material.

3. Protection according to claim 1, wherein the protective plate is built up by at least one layer fiber reinforced plastic.

4. Protection according to claim 3, wherein the protective plate is built up of multiple layers of fiber reinforced plastic with different fiber directions.

5. Protection according to claim 3, wherein the protective plate comprises any of the following fiber materials: carbon fiber and aramide fiber.

6. Protection according to claim 1, wherein the through-going holes have a diameter of 0.5-1.5 millimeter.

7. Protection according to claim 1, wherein the through-going holes have a diameter of 5-15 millimeter.

8. Protection according to claim 1, wherein the protective plate has a size and shape adapted for placing on the rear side of the user's leg such that the protective plate is adapted for covering the user's Achilles tendon.

9. Protection according to claim 8, wherein the protective plate extends along a central axis from a top side to a bottom side and wherein the protective plate flares transversely outward from the axis towards the bottom side.

10. Protection according to claim 9, wherein the protective plate further includes bottom wings extending from the bottom side in an axially downward and transversely outward direction.

11. Protection according to claim 1, comprising a first protective plate having a size and shape adapted for placing on the rear side of the user's leg such that the first protective plate is adapted for covering the user's Achilles tendon, and a second protective plate having a size and shape adapted for placing on the front of the user's leg such that the second protective plate is adapted for covering the user's shinbone.

12. Protection according to claim 1, wherein said at least one shock absorbing element comprises rubber.

13. Protection according to claim 1, wherein the one or more through-going ventilation holes are a multiplicity of through-going ventilation holes.

14. Protection according to claim 13, wherein the multiplicity of holes are arranged in rows and columns.

15. Protection according to claim 1, wherein the one or more through-going ventilation holes are two through-going ventilation holes.

16. Protection according to claim 1, wherein the two through-going ventilation holes are longitudinally spaced along the protective plate.

* * * * *